US008026782B2

(12) United States Patent
Mikl

(10) Patent No.: US 8,026,782 B2
(45) Date of Patent: Sep. 27, 2011

(54) MAGNET SYSTEM FOR AN ELECTRICAL ACTUATOR

(75) Inventor: Rudolf Mikl, Arbesthal (AT)

(73) Assignee: Tyco Electronics Austria GmbH, Vienna (AT)

( * ) Notice: Subject to any disclaimer, the term of this patent is extended or adjusted under 35 U.S.C. 154(b) by 313 days.

(21) Appl. No.: 12/103,780

(22) Filed: Apr. 16, 2008

(65) Prior Publication Data

US 2008/0266039 A1 Oct. 30, 2008

(30) Foreign Application Priority Data

Apr. 24, 2007 (DE) ..... 10 2007 019 684

(51) Int. Cl.
*H01F 3/00* (2006.01)

(52) U.S. Cl. ..... 335/281; 335/78

(58) Field of Classification Search ..... 335/78–86, 335/128–130

See application file for complete search history.

(56) References Cited

U.S. PATENT DOCUMENTS

| | | | | |
|---|---|---|---|---|
| 5,945,900 | A * | 8/1999 | Shibata et al. | 335/234 |
| 6,359,537 | B1 * | 3/2002 | Ichikawa et al. | 335/85 |
| 2001/0045878 | A1 * | 11/2001 | Fausch | 335/129 |

FOREIGN PATENT DOCUMENTS

| | | | |
|---|---|---|---|
| DE | 976 970 | | 10/1964 |
| DE | 2428109 | A1 | 1/1976 |
| EP | 0 817 230 | B1 | 10/2001 |
| EP | 1 009 008 | B1 | 5/2006 |
| EP | 1921647 | A | 5/2008 |
| GB | 100732 | A | 8/1916 |
| JP | 63061729 | U | 3/1988 |
| JP | 2005038618 | A | 2/2005 |
| WO | 2007/023792 | A1 | 3/2007 |

OTHER PUBLICATIONS

European Search Report for Application No. EP08007885, dated Oct. 23, 2009, 6 pages.

* cited by examiner

*Primary Examiner* — Anh Mai
*Assistant Examiner* — Bernard Rojas
(74) *Attorney, Agent, or Firm* — Barley Snyder

(57) ABSTRACT

A magnet system for an electrical actuator includes a substantially U-shaped magnet yoke having substantially parallel first and second pole legs connected by a yoke web. The first pole leg has a longitudinal end section bent out of a plane of the first pole leg. A longitudinal side of the longitudinal end section forms a first magnet pole. The second pole leg has an end face forming a second magnet pole.

23 Claims, 7 Drawing Sheets

MAGNET SYSTEM FOR AN ELECTRICAL ACTUATOR

CROSS-REFERENCE TO RELATED APPLICATIONS

This application claims the benefit of the filing date under 35 U.S.C. §119(a)-(d) of German Patent Application No. 10 2007 019 684.0, filed Apr. 24, 2007.

FIELD OF THE INVENTION

The invention relates to a magnet system for an electrical actuator comprising a substantially U-shaped magnet yoke having substantially parallel first and second pole legs connected by a yoke web.

BACKGROUND

Magnet systems for electrical actuators have broad industrial applicability in domestic, entertainment, motor vehicle, and industry sectors and are required, for example, in print relays, mains relays, miniature switching relays and miniature power relays. In the motor vehicle sector, so-called monostable or bistable relays are also required. These include, for example, bistable latching relays, which without further energy conversion remain continuously in a closed or open state, in order to reduce power conversion of a motor vehicle. Monostable relays, such as, for example, for an indicating device of the motor vehicle, return to their original open or closed state following excitation of a coil body.

Because of their mass use, the above-described electrical actuators need to be manufactured as cheaply as possible. The best way to reduce the cost of a mass produced electrical actuator is to minimize the material consumption of a magnet system in the electrical actuator. This relates in particular to the coil body, which comprises an excitation winding consisting mostly of precious metals, such as copper and silver. Furthermore, this relates to the magnet yoke, which should preferably likewise be able to be manufactured with a low material consumption. Moreover, it is advantageous particularly in cramped conditions if such an electrical actuator has a minimal space requirement.

SUMMARY

It is therefore an object of the invention to provide a magnet system for an electrical actuator which has a low unit price and small dimensions.

This and other objects are achieved by a magnet system for an electrical actuator comprising a substantially U-shaped magnet yoke having substantially parallel first and second pole legs connected by a yoke web. The first pole leg has a longitudinal end section bent out of a plane of the first pole leg. A longitudinal side of the longitudinal end section forms a first magnet pole. The second pole leg has an end face forming a second magnet pole.

This and other objects are further achieved by a magnet system for an electrical actuator comprising a substantially U-shaped magnet yoke having a core leg extending substantially parallel to a yoke leg. The core leg and the yoke leg are connected by a yoke web. The yoke leg has a longitudinal end section bent out of a plane of the yoke leg that extends substantially perpendicular thereto. The yoke leg has a widened region extending from a substantially center region of the yoke leg through the longitudinal end section. A longitudinal side of the longitudinal end section forms a yoke pole. The core leg is provided with a coil body. The core leg has an end face forming a second magnet pole.

DETAILED DESCRIPTION OF THE EMBODIMENT(S)

Figure 1:
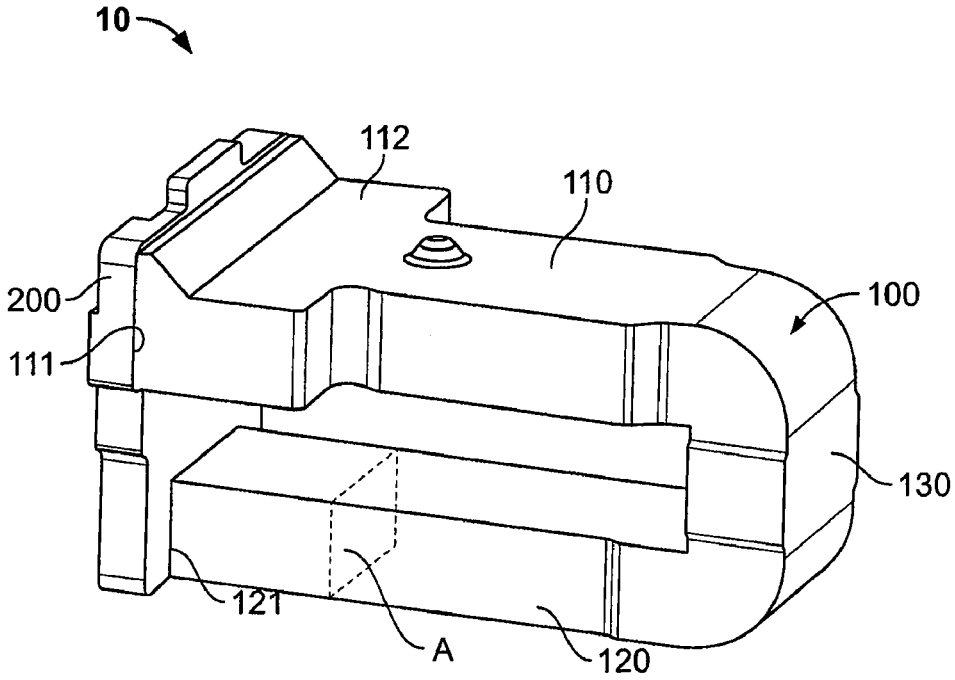
Fig. 1 (Prior Art)
FIG. 1 is a perspective view of a magnet system according to the prior art.
Figure 2:
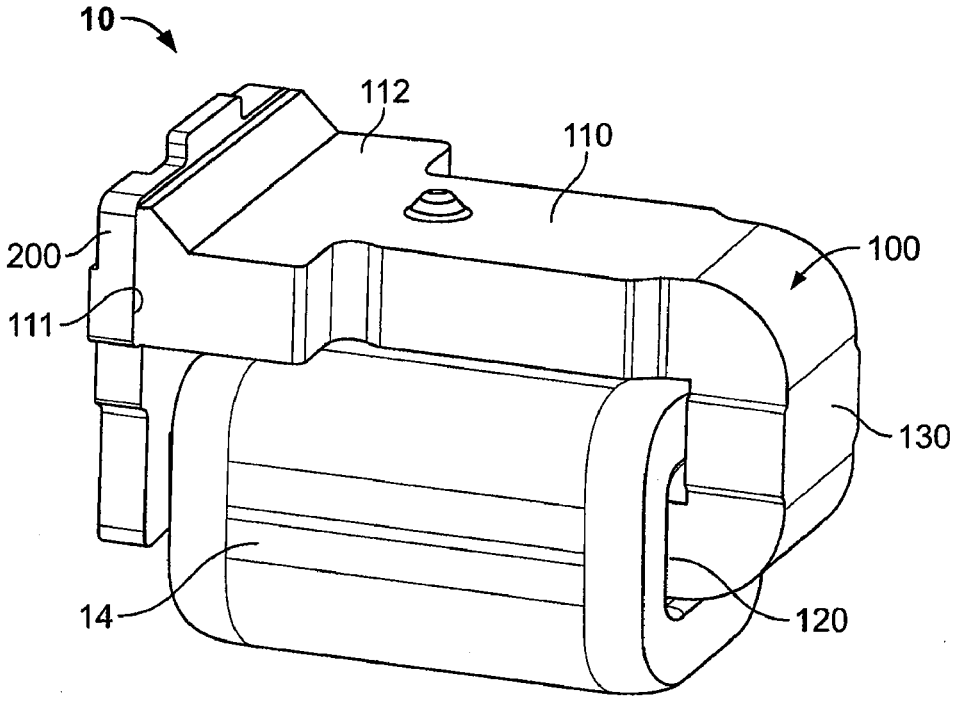
Fig. 2 (Prior Art)
FIG. 2 is a perspective view of the magnet system from FIG. 1 showing a coil body arranged on a core leg.
Figure 3:
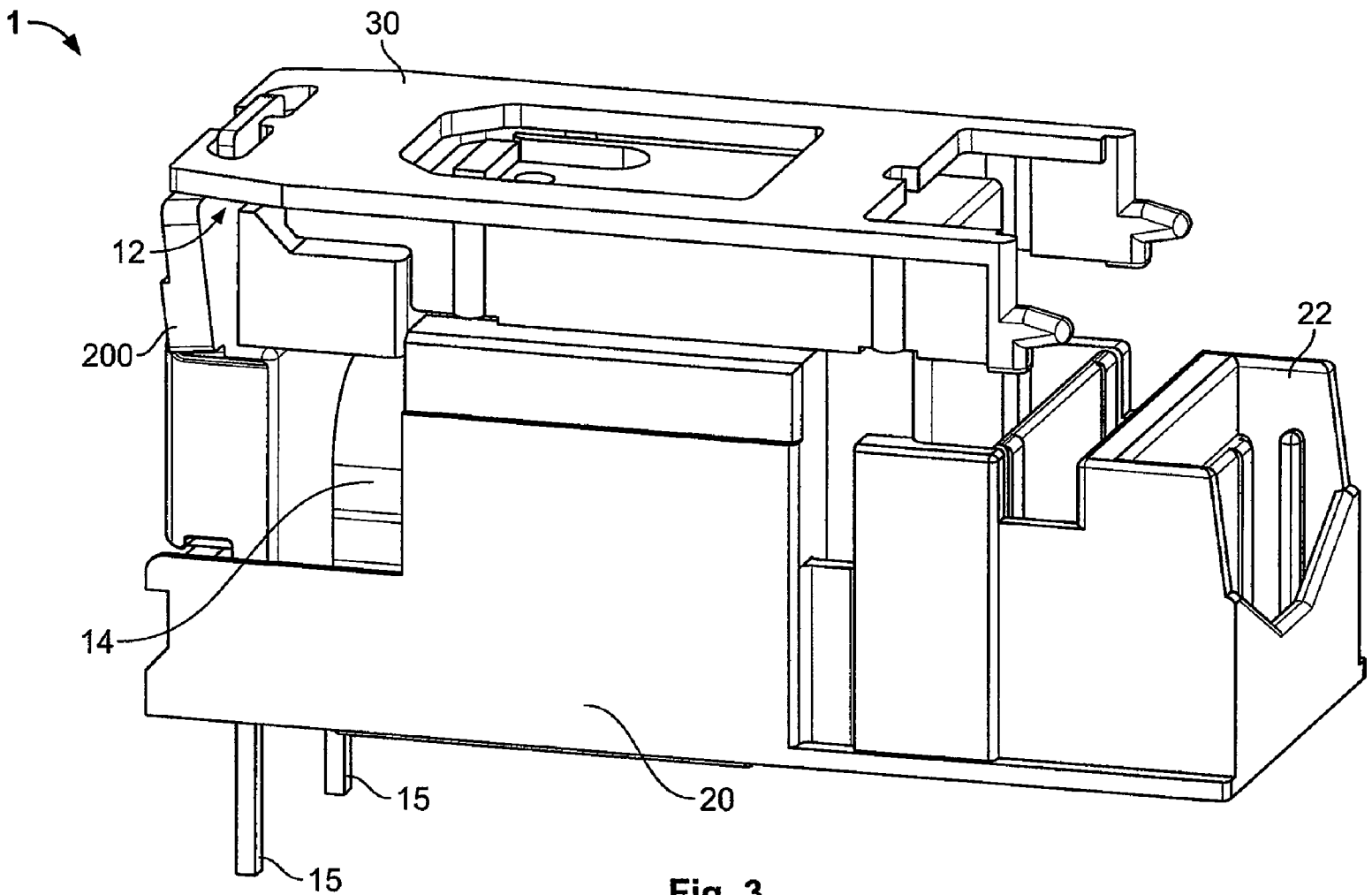
Fig. 3 (Prior Art)
FIG. 3 is a perspective view of an electrical actuator according to the prior art with the magnet system from FIG. 2.

FIGS. 1-3 show a magnet system 10 for an electrical actuator 1 according to the prior art. The electrical actuator 1 may be, for example, a power relay or a mains relay. As shown in FIG. 1, the magnet system 10 has a substantially U-shaped magnet yoke 100. The magnet yoke 100 includes first and second pole legs consisting of a yoke leg 110 and a core leg 120, respectively. The core leg 120 and the yoke leg 110 are integrally connected by a yoke web 130. The yoke leg 110 extends substantially parallel to the core leg 120, and the yoke web 130 extends there between and substantially perpendicularly thereto. The yoke web 130 has substantially the same cross-sectional area A as the core leg 120. The magnet yoke has first and second magnet poles consisting of a yoke pole 111 and a core pole 121, respectively. An end face of the core leg 120 forms the core pole 121, and an end face of the yoke leg 110 forms the yoke pole 111. The core pole 121 and the yoke pole 110 lie substantially in the same plane. To conduct a magnetic flux better in an area of the yoke pole 111, the yoke leg 110 has a widened region 112 at an end thereof. As shown in FIG. 2, a coil body 14 is disposed about the core leg 120.

An elongated, plate-shaped, and substantially flat hinged armature 200 is provided at a free end of the core leg 120. The armature 200 is supported by an armature spring (not shown) and pivots between an open position shown in FIG. 3 and a closed position shown in FIGS. 1-2 depending on the excitation of the coil body 14. In the open position, at least one portion of the armature 200 abuts the core pole 121 of the core leg 120. In the closed position, the armature 200 abuts the core pole 121 and the yoke pole 111. The mechanical contact surfaces of the armature 200 may be located, for example, longitudinal end sections thereof.

For example, starting with the armature 200 in the open position, when a corresponding flow of current goes through the coil body 14, the folded-back armature 200 moves, due to the spring force of the armature spring (not shown), towards the yoke pole 111 and contacts the yoke pole 111 on a front face thereof. An analogous occurrence takes place with the core pole 121. In the closed position, the magnetic circuit is closed via the yoke pole 111 of the yoke leg 110 and the core pole 121 of the core leg 120, which circuit opens again when the current is removed from the coil body 14.

As shown in FIG. 3, the magnet system 10 is arranged in an insulating housing 20. The coil body 14 is supplied with a current via electrical connections 15 extending into the housing 20. The armature 200 is connected to a slide 30, which is coupled to the armature 200 at a side 12. On a side opposite the armature 200, the slide 30 is connected to moveable spring contacts (not shown) arranged in a receptacle 22 on the housing 20. The slide 30 can move the moveable spring contacts 30 into contact with fixed spring contacts (not shown) also arranged in the receptacle 22, as a result of movement of the armature 200.

In the electrical actuator 1 shown in FIGS. 1-3, the electrical actuator 1 and/or the magnet system 10 has a fixed external dimension dependent upon the winding height of the coil body 14 or the predetermined number of windings in the coil body 14, and the yoke pole 111 has a surface area dependent upon the characteristics of the coil body 14. Thus, it is difficult to alter the characteristics of the electrical actuator 1 and/or the magnet system 10, because lowering the winding height of the coil body 14 or reducing the number of windings in the coil body 14 results in a smaller magnetic flux with the same electrical activation of the coil body 14.

Figure 4:
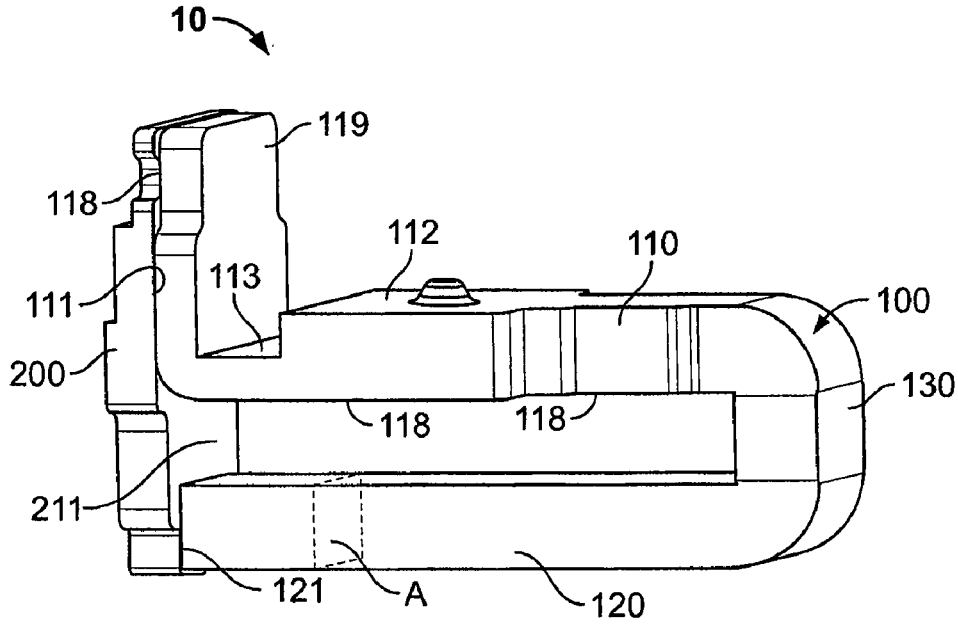
FIG. 4 is a perspective view of a magnet system according to a first embodiment of the invention.
Figure 5:
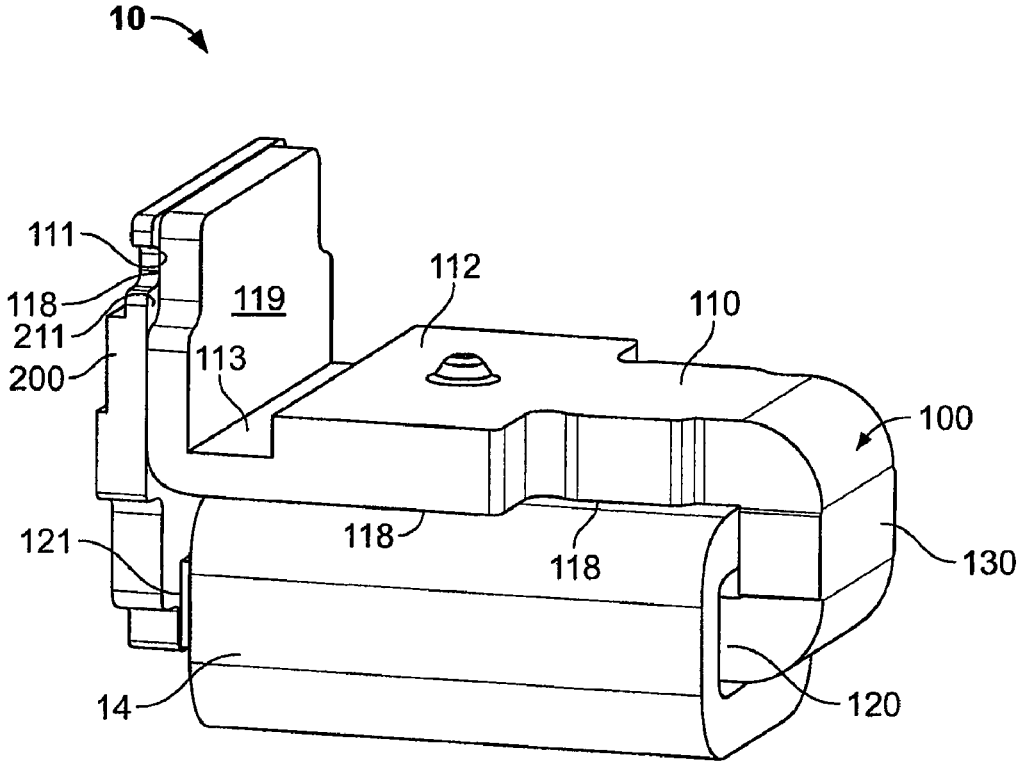
FIG. 5 is a perspective view of the magnet system from FIG. 4 showing the coil body arranged on the core leg.
Figure 6:
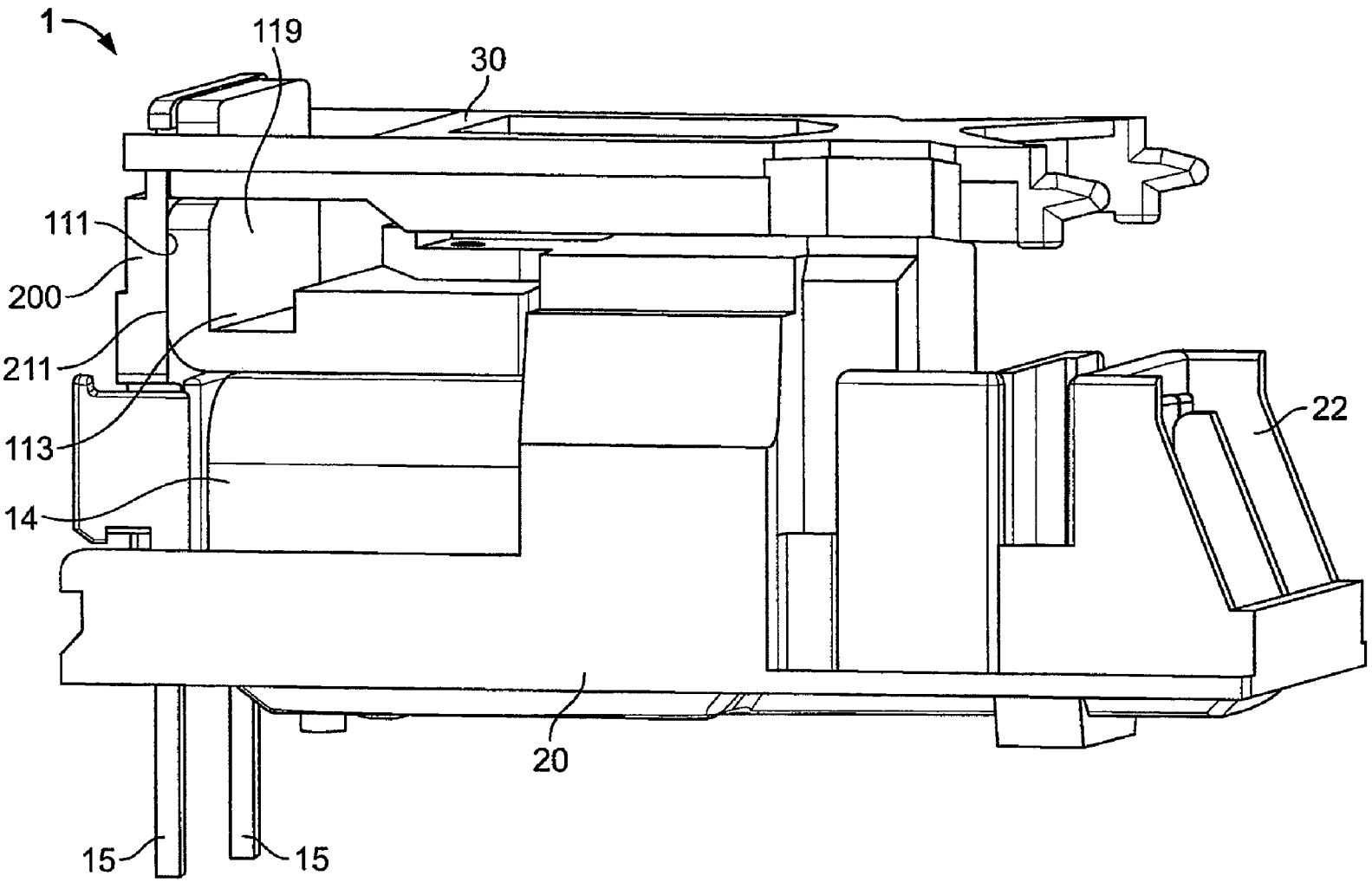
FIG. 6 is a perspective view of an electrical actuator with the magnet system from FIG. 4.

FIGS. 4-6 show the electrical actuator 1 configured with a magnet system 10 according to a first embodiment of the invention. In the magnet system 10 according to the first embodiment of the invention, the winding height of the coil body 14 and/or the number of windings in the coil body 14 has been reduced and the surface area of the yoke pole 111 has been enlarged while overcoming the disadvantages of the prior art.

As shown in FIGS. 4-5, the surface area of the yoke pole 111 is enlarged by providing a bend in the yoke leg 110 at a free longitudinal end section 119 of the yoke leg 110 adjacent the armature 200. The longitudinal end section 119 is bent out of the plane of the yoke leg 110 and substantially perpendicular thereto. In the illustrated embodiment, the longitudinal end section 119 is bent away from the core leg 120 and substantially perpendicular thereto. The surface area of the yoke pole 111 may be varied by varying the length of the bent longitudinal end section 119.

To better conduct the magnetic flux in the area of the yoke pole 111, the widened region 112 of the yoke leg 110 extends from a substantially central region of the yoke leg 110 through the longitudinal end section 119. To facilitate the bending of the longitudinal end section 119, a portion of the widened region 112 adjacent the longitudinal end section 119 is provided with a recess 113 on a side of the yoke leg 110 facing away from the core leg 120. The recess 113 allows the bending of the longitudinal end section 119 to be made easier and makes sure no material disruptions occur in the area of the bending.

As a result of the bend, the yoke pole 111 of the yoke leg 110 is no longer formed from the end face of the yoke leg 110, but is formed from a section of a longitudinal side 118 of the yoke leg 110. In the illustrated embodiment, the longitudinal side 118 is the side of the yoke leg 110 opposite from the side of the yoke leg 110 having the recess 113. In other words, the longitudinal side 118 is the side of the yoke leg 110 which is or was facing the core leg 120. Thus, the longitudinal side 118 of the longitudinal end section 119 is mechanically contactable by the armature 200 when the armature 200 is in the closed position.

In order to facilitate contact by the armature 200, the core pole 121 and the yoke pole 111 lie in substantially the same plane. In the illustrated embodiment, this plane extends substantially perpendicular to a longitudinal extension of the core leg 120 and the yoke leg 110 and substantially parallel to a transverse extension of the of the core leg 120 and the yoke leg 110. For this purpose, the longitudinal end section 119 of the yoke leg 110 is bent correspondingly and the core pole 121 of the core leg 120 is arranged correspondingly beveled relative to a remainder of the core leg 120. It will be appreciated by those skilled in the art, however, that the yoke pole 111 and the core pole 121 need not lie in substantially the same plane and could alternatively be offset in a direction of the core leg 120 and the yoke leg 110 or the core pole 121 and/or the yoke pole 111 could be arranged at an angle relative to the core leg 120 and the yoke leg 110. The armature 200 would then need to be configured to compensate for the aforementioned deviations.

In the magnet system 10 shown in FIGS. 4-6, the height of the yoke web 130 is reduced and therefore the distance between the pole leg 110 and the core leg 120 is reduced due to the reduction in the winding height of the coil body 14. The longitudinal end section 119 of the yoke leg 110 then utilizes the space freed by the reduction in the winding height of the coil body 14. As a result, the height of the coil body is reduced over the prior art, but the electrical actuator 1 has the same dimensions as a result of the addition of the longitudinal end section 119 and the increase in the height of a contact side 211 of the armature 200. Additionally, a free space (not shown) may be provided between the armature 200, the core leg 120, the coil body 14, and the yoke leg 110 on which the bend for the longitudinal end section 119 is provided.

FIG. 6 shows the magnet system 10 arranged in the housing 20. Due to the shape of the magnet system 10, more space is available in the region outside the yoke leg 110 and on the right (with reference to FIG. 6) next to the yoke pole 111 for the slide 30, which is coupled to the armature 200. Due to the available space, the danger of the slide 30 touching a cover (not shown) of the electrical actuator 1 and thus being able to be blocked is minimized. Moreover, because the housing 20 and the cover (not shown) are made from a plastic material, the housing 20 and the cover can be configured more simply according to the invention.

Figure 7:
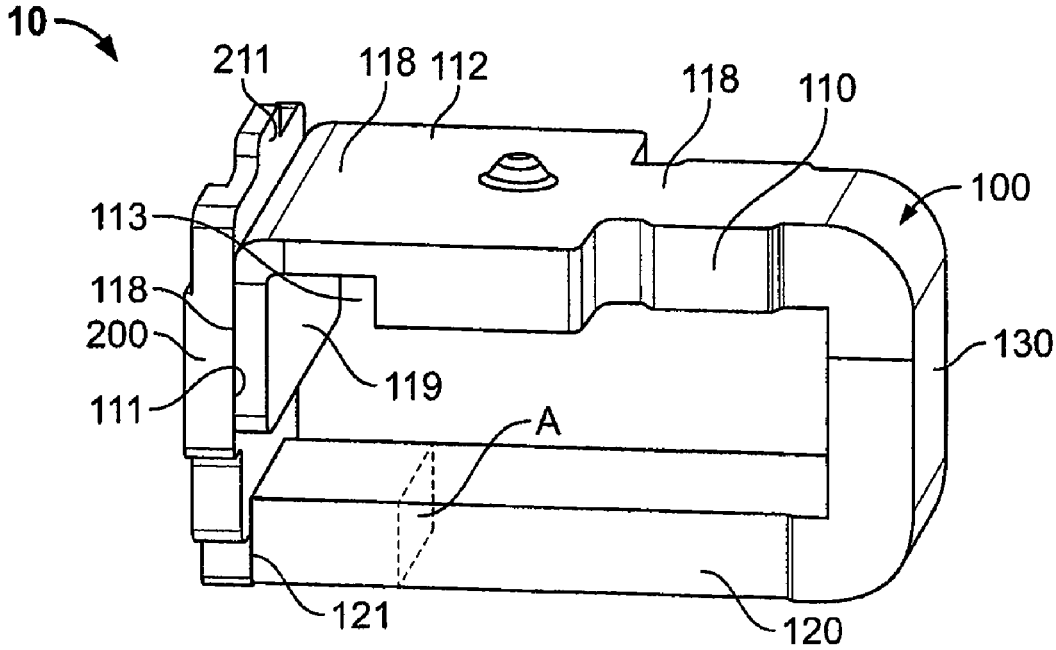
FIG. 7 is a perspective view of a magnet system according to a second embodiment of the invention.
Figure 8:
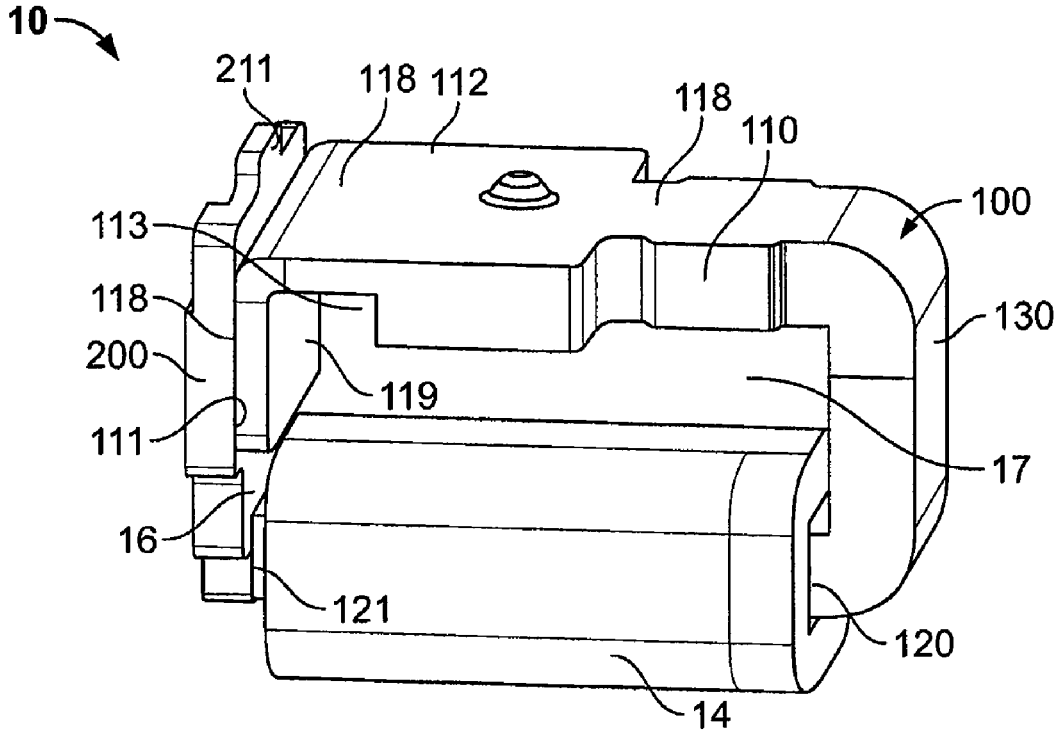
FIG. 8 is a perspective view of the magnet system from FIG. 7 showing the coil body arranged on the core leg.
Figure 9:
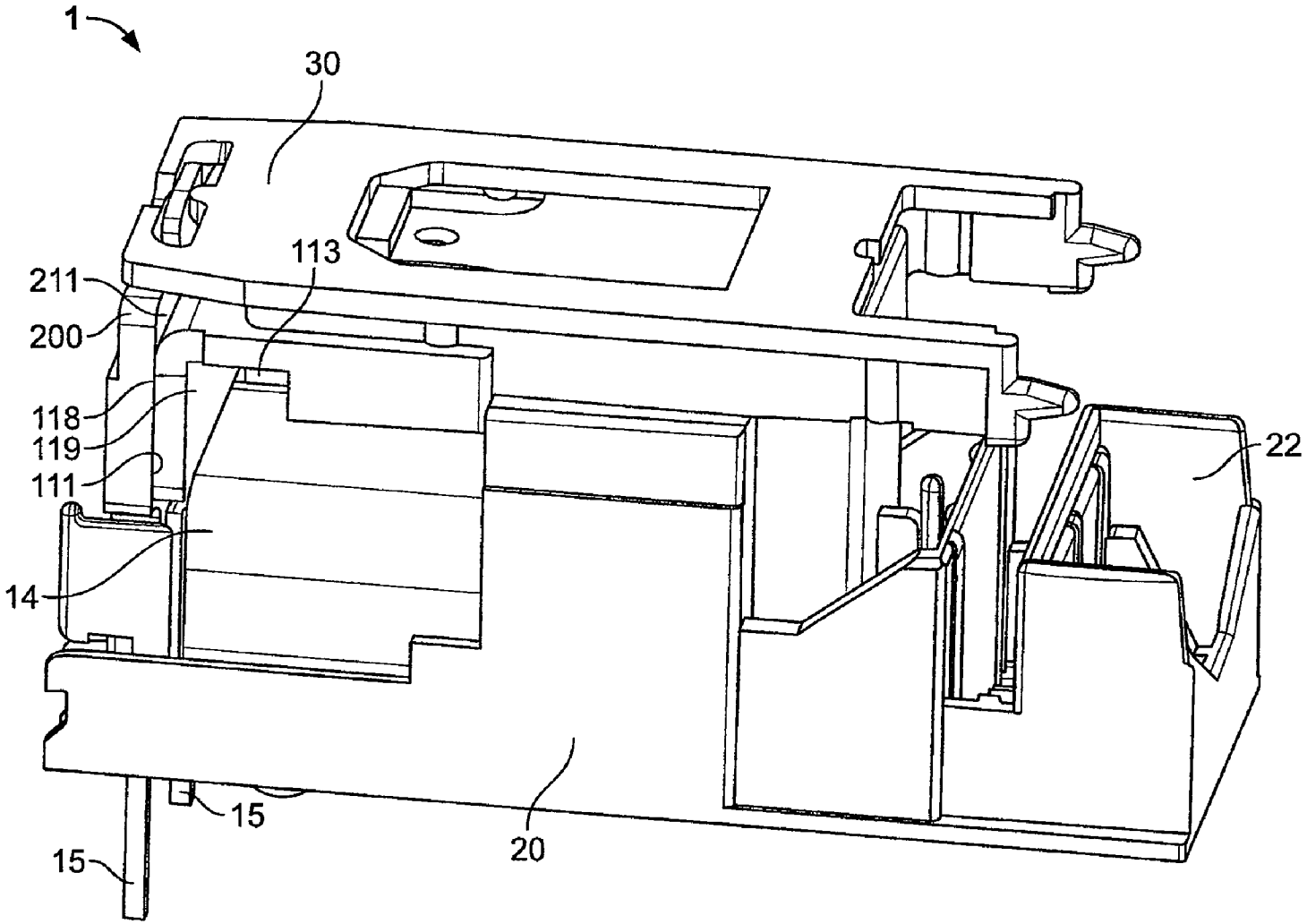
FIG. 9 is a perspective view of an electrical actuator with the magnet system from FIG. 7.

FIGS. 7-9 show the electrical actuator 1 configured with a magnet system 10 according to a second embodiment of the invention. In the magnet system 10 according to the second embodiment of the invention, the longitudinal end section 119 of the yoke leg 110 is bent towards the core leg 120. The longitudinal end section 119 is configured such that the longitudinal end section 1119 does not overlap the coil body 14 and therefore does not cause any magnetic interference fields in the yoke pole 111. The longitudinal side 118 of the yoke leg 110 facing away from the core leg 120 now forms the yoke pole 111. To facilitate the bending of the longitudinal end section 119, a portion of the widened region 112 adjacent the longitudinal end section 119 is provided with a recess 113 on a side of the yoke leg 110 facing towards the core leg 120. In other words, the recess 113 is formed on the side of the yoke leg 110 opposite from the longitudinal side 118 of the yoke leg 110 which forms the yoke pole 111.

As shown in FIG. 8, a free space 17 is formed in the magnet system 10 between the coil body 14 and the yoke leg 110, as a result of the increase in the height of the yoke web 130 to accommodate the longitudinal end section 119. Due to the free space 17 between the coil body 14 and the yoke leg 110, space is created for further devices of the electrical actuator 1, as shown FIG. 9. Furthermore, a free space 16 is provided between the armature 200, the core leg 120, the coil body 14, and the yoke leg 110. Because the magnet system 10 according to the second embodiment of the invention has similar dimensions to the magnet system 10 of the prior art, the magnet system 10 can more easily be worked into an existing assembly system.

Figure 10:
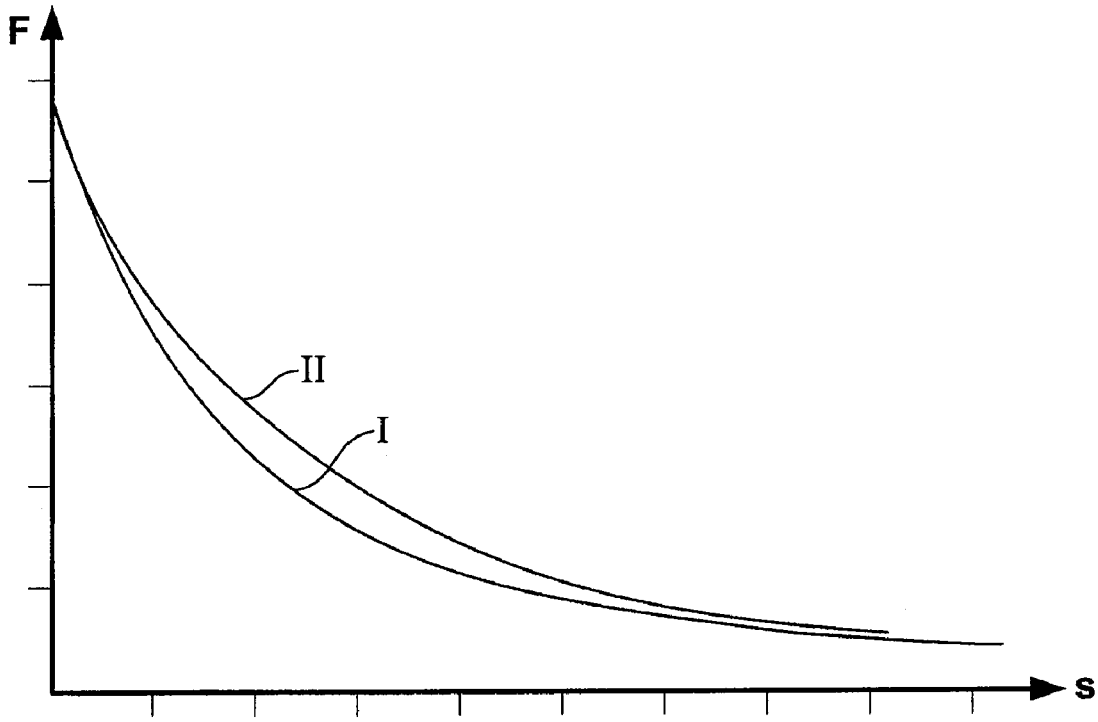
FIG. 10 is a diagram comparing a magnet curve of the magnet system according to the prior art and a magnet curve of a comparable magnet system according to the invention.

FIG. 10 shows a comparison of a magnet curve I produced by the electrical actuator 1 of the prior art and a magnet curve II produced by the electrical actuator 1 of the invention. The abscissa of the diagram is an average distance s between the armature 200 and the yoke pole 111 and the ordinate of the diagram is a magnetic force F between the armature 200 and the yoke pole 111.

Magnet curve I represents the magnet system 10 of the prior art with the cross-sectional area A of the core leg 120 of approximately 4.0-4.5 mm×2.5 mm. The magnet curve II represents the magnet system 10 according to the invention with the winding height of the coil in the coil body 14 being reduced by approximately 35-45%, preferably by approximately 40%, and the area of the yoke pole 111 is increased by approximately 45-65%, preferably by approximately 50-60%. The cross-sectional area A of the core leg 120 is approximately 4.5-5.0 mm×2.0 mm. In this case a material thickness of the magnet yoke 100, in particular a material thickness of the core leg 120, can be reduced by approximately 10-25%, in particular by approximately 12.5-20% and preferably by approximately 15%.

It is easily recognizable that the magnet system 10 according to the invention with the enlarged end surface of the yoke pole 111 and smaller coil body 14 is considerably stronger in the relevant open state of the magnet system 10 than the magnet system 10 according to the prior art. Due to the reduction in the winding height of the coil body 14, a substantial amount of the coil, which consists mostly of copper or silver, can be saved. Due to this, the magnet system 10 with the coil body 14 does not become weaker due to the minimized use of expensive metals, but even somewhat stronger in the relevant open state of the electrical actuator 1. The reason for this is the markedly greater area of the yoke pole 111, which at least compensates for the disadvantage of the reduced winding height.

Thus compared with the prior art, which has a cross-sectional area A of the magnet yoke 100 in the region of the coil body 14 of 4.0-4.5 mm×2.5 mm, a quantity of copper that is approximately 40-50% smaller results in the case of the cross-section of the magnet yoke 100 of the invention in the cross-sectional area A of the coil body 14 of 4.0-5.0 mm×2.0 mm and an enlargement of the end surface of the yoke pole 111 by 50-60%. Thus, the cross-sectional area A of the magnet yoke 100 in the region of the coil body 14 and preferably also in a region of the yoke web 130 is approximately 4-13 $mm^2$, preferably approximately 5-12.5 $mm^2$, more preferably approximately 7.5-11.5 $mm^2$, in particular approximately 8.5-10.5 $mm^2$ and in particular preferably approximately 9-10 $mm^2$. In the electrical actuator 1 according to the invention, the yoke pole 111 is approximately 40-80 $mm^2$, preferably approximately 45-70 $mm^2$, more preferably approximately 50-65 $mm^2$, in particular approximately 55-62.5 $mm^2$ and in particular preferably approximately 57.5-60 $mm^2$ and/or a mass for the coil body 14 is approximately 1.0-3.5 g, 1.25-3.25 g, preferably approximately 1.5-3 g, in particular approximately 1.7-2.5 g, in particular preferably approximately 1.8-2.25 g and in particular especially preferably approximately 1.9-2.1 g. Thus, for the magnet system 10 according to the invention, for example, a minimization of the copper requirement for the coil body 14 from 3.5 g in the prior art to 1.9 g thus results. A contact overlap of the contact side 211 of the armature 200, relative to its overall lateral area between the yoke pole 111 and the core pole 121 is approximately 30-70%, preferably approximately 35-60%, in particular approximately 40-55% and in particular preferably approximately 45-50% with the yoke pole 111.

As a result, it is possible according to the invention to significantly increase the magnetic force F between the armature 200 and the yoke pole 111 when current is flowing to the coil body 14, by reducing the winding height of the coil body 14 and increasing the area of the yoke pole 111.

Due to the fundamental idea of the invention wherein reduction of an exciter mass of the coil body 14 and compensation or overcompensation for this assumed disadvantage by enlargement the yoke pole 111, not only is this invention applicable to magnet systems for the relays 1, but the invention is applicable to all magnet systems for electrical actuators such as, for example, monostable or bistable electrical actuators. This relates to, for example, miniature print relays, mains relays, power relays, card relays, safety relays, industrial relays, multimode relays etc.

The foregoing illustrates some of the possibilities for practicing the invention. Many other embodiments are possible within the scope and spirit of the invention. For example, the arrangement of the components of the invention is magnetically or kinematically reversible. It is thus possible, for example, to exchange the yoke leg 110 and the core leg 120. Furthermore, it is conceivable to provide or couple an armature 200 not on the core leg 120 but on the yoke leg 110. It is also possible also to provide the coil body 14 on the yoke leg 110. These variants may be realized individually or in combination in all embodiments of the invention. It is, therefore, intended that the foregoing description be regarded as illustrative rather than limiting, and that the scope of the invention is given by the appended claims together with their full range of equivalents.

What is claimed is:

1. A magnet system for an electrical actuator, comprising:

a substantially U-shaped magnet yoke having substantially parallel first and second pole legs connected by a yoke web;

the first pole leg having a longitudinal end section bent out of a plane of the first pole leg, the first pole leg having a widened region extending from a substantially center region of the first pole leg through the longitudinal end section, a longitudinal side of the longitudinal end section forming a first magnet pole;

and the second pole leg having an end face forming a second magnet pole;

wherein the first pole leg is a yoke leg and the second pole is a core leg, the core leg being provided with a coil body.

2. The magnet system of claim 1, wherein the longitudinal end section extends substantially perpendicular to the first pole leg.

3. The magnet system of claim 1, further comprising an armature that pivots between an open position and a closed position, the armature contacting at least the first magnet pole in the closed position.

4. The magnet system of claim 3, wherein an elongated, plate-shaped, and substantially flat hinged armature is sized to be substantially similar to the first magnet pole.

5. The magnet system of claim 1, wherein the first and second magnet poles are in the same plane.

6. The magnet system of claim 1, wherein the first magnet pole has a larger contact area than the second magnet pole.

7. The magnet system of claim 1, wherein the second pole leg and the yoke web have the same cross-sectional area.

8. The magnet system of claim 1, wherein the longitudinal end section extends toward the second pole leg.

9. The magnet system of claim 8, wherein the height of the yoke web is sized to accommodate the longitudinal end section between the first and second pole legs.

10. The magnet system of claim 9, wherein a space is formed between the coil body and the yoke leg.

11. The magnet system of claim 1, wherein the longitudinal end section extends away from the second pole leg.

12. The magnet system of claim 1, wherein the widened region has a recess adjacent the longitudinal end section.

13. The magnet system of claim 1, wherein a space is located between the coil body and the first pole leg.

14. Magnet system for an electrical actuator, comprising:

a substantially U-shaped magnet yoke having a core leg extending substantially parallel to a yoke leg, the core leg and the yoke leg being connected by a yoke web;

the yoke leg having a longitudinal end section bent out of a plane of the yoke leg and extending substantially perpendicular thereto, the yoke leg having a widened region extending from a substantially center region of the yoke leg through the longitudinal end section, a longitudinal side of the longitudinal end section forming a yoke pole; and the core leg being provided with a coil body, the core leg having an end face forming a second magnet pole.

15. The magnet system of claim 14, further comprising an armature pivots between an open position and a closed position, the armature contacting at least the yoke pole in the closed position.

16. The magnet system of claim 15, wherein an elongated, plate-shaped, and substantially flat hinged armature is sized to be substantially similar to the yoke pole.

17. The magnet system of claim 14, wherein the yoke pole and the core pole are in the same plane.

18. The magnet system of claim 14, wherein the yoke pole has a larger contact area than the core pole.

19. The magnet system of claim 14, wherein the core leg and the yoke web have the same cross-sectional area.

20. The magnet system of claim 14, wherein the widened region has a recess adjacent the longitudinal end section.

21. The magnet system of claim 14, wherein the longitudinal end section extends toward the core leg.

22. The magnet system of claim 21, wherein the height of the yoke web is sufficient to accommodate the longitudinal end section between the yoke and core legs.

23. The magnet system of claim 14, wherein the longitudinal end section extends away from the core leg.

* * * * *